United States Patent [19]

Morihara et al.

[11] Patent Number: 4,689,602

[45] Date of Patent: Aug. 25, 1987

[54] RAILWAY CAR ORDER SELECTING SYSTEM

[75] Inventors: Kenji Morihara; Hidetoshi Homma; Kenji Sunami, all of Hyogo, Japan

[73] Assignee: Mitsubhiki Denki Kabushiki Kaisha, Tokyo, Japan

[21] Appl. No.: 837,239

[22] Filed: Mar. 7, 1986

[30] Foreign Application Priority Data

Mar. 20, 1985 [JP] Japan ..... 60-54291

[51] Int. Cl.[4] ..... B61L 15/00

[52] U.S. Cl. ..... 340/48; 340/536

[58] Field of Search ..... 340/48, 47, 825.05, 340/825.51, 533, 536

[56] References Cited

U.S. PATENT DOCUMENTS

| | | | |
|---|---|---|---|
| 3,696,758 | 10/1972 | Godinez, Jr. | 340/48 X |
| 3,728,701 | 4/1973 | Reynolds et al. | 340/536 |
| 3,905,012 | 9/1975 | Vrabel et al. | 340/48 |
| 4,187,504 | 2/1980 | Cantrell | 340/48 X |
| 4,438,434 | 3/1984 | Wason | 340/825.51 |

*Primary Examiner*—James L. Rowland
*Assistant Examiner*—Brian R. Tumm
*Attorney, Agent, or Firm*—Sughrue, Mion, Zinn, Macpeak & Seas

[57] ABSTRACT

A railway car order selecting system in which data representing the positional order of the various cars of a train and other data is accurately communicated to a central station regardless of the particular arrangement of the cars. A selecting relay applies an input signal to one of plural data transmitting devices, one being located on each car, to select a front car of the train. Extension lines connected into a single line connect the data transmitting devices to one another and are used for selecting the car order. Logic circuits are provided for the extension lines to supply, in response to an output signal from the respective data transmitting devices, a supply voltage to the following data transmitting device. Selection of the front car in this manner results in starting the data transmitting devices on the following cars successively and registering the positional order of the following cars in the data transmitting device at the front car.

5 Claims, 5 Drawing Figures

RAILWAY CAR ORDER SELECTING SYSTEM

BACKGROUND OF THE INVENTION

The present invention relates to a car order selecting system for a railway train in which data series-connected transmitting devices are provided on the various cars.

Heretofore, the arrangement of railway cars having series-connected data transmitting devices has been fixed. A data transmitting device serving as the central station is installed on the front car and data transmitting devices serving as terminal station are installed on the following cars. Accordingly, the positional order of the data transmitting devices on the cars is physically fixedly determined, and therefore the data transmitting device serving as the central station carries out transmission control according to station numbers and the positional order of the data transmitting devices, which have been registered in advance in accordance with a polling selection transmission procedure.

FIG. 1 is a connection diagram of a railway car order selecting device of a type described, for instance, in "Collection of Railway Cybernetics Utilization Domestic Symposium Papers", vol. 19, pp. 496. As shown in FIG. 1, data transmitting devices 104*a*, 104*b* and 104*c*, corresponding to the first, second and third railway cars, are provided on railway cars 101, 102 and 103, respectively. These devices 104*a*, 104*b* and 104*c* are connected through transmitting lines 105. The train is fixedly formed by three cars, the first through third carriages.

The operation of the car order selecting device will be described. The data transmitting device on one (the front carriage 101 or 103) of the three cars 101 through 103 operate as the central station, and the remaining data transmitting devices serve as terminal stations. It is assumed that the first car 101 is the front car. In this case, the data transmitting device 104*a* is the central station. The central station 104*a* polls the terminal stations 104*b* and 104*c* successively to collect data from the terminal stations. The data thus collected is edited and displayed on a display unit 106*a*. The data thus displayed is transmitted to the terminal station through the transmitting lines 105 so as to be displayed on the display unit 106*c*. The terminal stations 104*b* and 104*c* have car number selecting switches (not shown) to determine their own station numbers (such as 2 and 3). Each terminal station transmits (automatic data) to the central station 104*a* only when requested to answer with its station number specified. However, since the cars are in the fixed formation, they must be arranged in the order of numbers.

As is apparent from the above description, the conventional car order selecting system is of the semifixed type in which the station numbers of the data transmitting devices are determined by operating selecting switches corresponding to the car numbers. Therefore, when trains are combined together, a plurality of data transmitting devices have the same station number, as a result of which it becomes difficult to transmit data between the data transmitting devices, and it is impossible to accurately detect the positions of the various cars in the train.

In a variable formation type train of more than two cars in which the front-to-rear direction of a car can be changed whenever it is connected, the central station on the front car cannot detect the numbers of terminal stations provided on the following cars or the station numbers and the positional order of the terminal stations. Therefore, the central station cannot communicate with the terminal stations, and cannot display data such as the name of equipment which is out of order and the position of the car having the equipment. Furthermore, in the case where it is required to provide some indication to the operator in response to the data of the data transmitting devices, even if it were possible to communicate with the data transmitting device, it would be impossible to communicate to the operator the correct data because the positional order of the data transmitting device is unknown.

SUMMARY OF THE INVENTION

Accordingly, an object of the present invention is to eliminate the above-described difficulties.

In accordance with the above object, in a variable formation type train, the central station is provided on the front car, and the registration order of the terminal station numbers of the following cars is accurately registered in the central station, whereby the data of the data transmitting devices can be correctly and quickly transmitted to the central station and displayed thereat.

More specifically, a car order selecting device of the invention comprises: extension lines which are connected into one line to apply a supply voltage to an adjacent data transmitting device; and logic circuits for selectively connecting the extension lines so that the station numbers of the terminal station data transmitting devices on the following cars are registered in the central station data transmitting device at the front car, whereby the positional order of the cars is determined.

In the car order selecting system of the invention, when the front car is selected, the data transmitting device on the front car functions as the central station, and a supply voltage is supplied successively to the data transmitting devices on the following cars through the extension lines having the logic circuits. Therefore, the data from the data transmitting devices on the following cars is correctly and quickly inputted to the central station data transmitting device.

DESCRIPTION OF THE PREFERRED EMBODIMENTS

Figure 2:
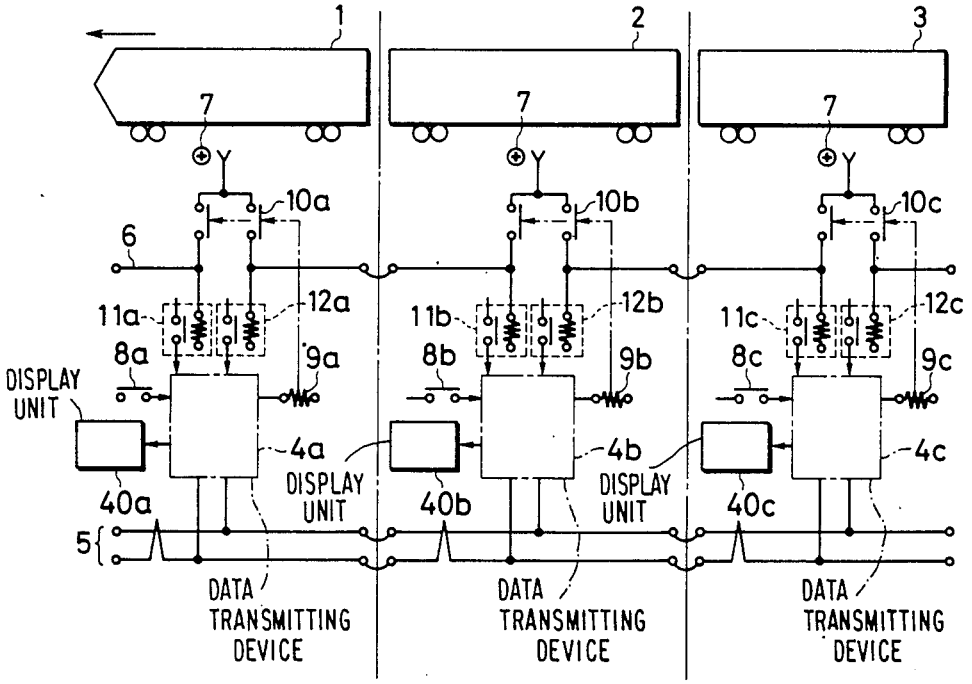
FIG. 2 is a connecting diagram of a preferred embodiment of the invention.

A preferred embodiment of the invention will be described with reference to FIG. 2. FIG. 2 shows a train composed of three cars; however, it should be noted that the arrangements and functions described below are applicable to the case also where more than three cars form a train.

In FIG. 2, reference numeral 1 designates the first car, which is the front car in the train; 2 and 3, the second and third cars, which are the following cars; and 4*a*, 4*b* and 4*c*, data transmitting devices installed on the cars 1, 2 and 3, respectively, the devices being used to transmit data from the respective cars to one another through data transmitting lines 5, which are connected to the data transmitting devices 4*a*, 4*b* and 4*c*. It is assumed that the train runs in the direction of the arrow (to the left in FIG. 2), and the data transmitting device 4*a* on the first 1 serves as the central station while the data transmitting devices 4*b* and 4*c* on the following cars 2 and 3 serve as terminal stations.

Further in FIG. 2, reference numeral 6 designates extension lines provided for each data transmitting device, the lines 6 being connected to the data transmitting devices on the immediately front and rear cars, respectively, and are used to connect a power source 7 to each car; 7, the power sources provided on the cars 1 through 3, respectively, each power source being used to selectively apply signals to the data transmitting devices on the front and rear cars from the transmitting devices on the front and rear cars from the transmitting device on a given car; 8*a*, 8*b* and 8*c*, selecting relays, namely, head control relays which transmit input signals to the data transmitting devices 4*a*, 4*b* and 4*c* to select the front car so that the data transmitting device on the front car thus selected becomes the central station; and 9*a*, 9*b* and 9*c*, and 10*a*, 10*b* and 10*c*, control relay coils and control relay contacts which form respective control relays. Each control relay is used to supply, when the data processing operation in the central station (data transmitting device) 4*a* is accomplished or the data processing operation (registration of a predetermined station number with respect to the central station and a predetermined car number, etc.) in the terminal stations (data transmitting devices) 4*b* and 4*c* is accomplished, a start output signal to the terminal station on the next car to cause the latter to start data communication with the central station 4*a*.

Further in FIG. 2, 11*a*, 11*b* and 11*c*, and 12*a*, 12*b* and 12*c* designate signal receiving relays receiving the start output signal when the supply voltage 7 is applied through the control relay contacts 10*a*, 10*b* and 10*c*. The signal receiving relays together with the control relays 9*a* through 9*c* and 10*a* through 10*c* form logic circuits for connecting the extension line 6 selectively to the data transmitting devices 4*a*, 4*b* and 4*c*. Monitoring display units 40*a*, 40*b* and 40*c* are connected to the data transmitting devices 4*a*, 4*b* and 4*c*, respectively.

The operation of the car order selecting device thus constructed will be described with reference to FIGS. 2 and 3. When the car 1 is selected as the front car, the selecting relays 8*a* is turned on (FIG. 3, (A)). Upon detection of this operation, the data transmitting device 4*a* turns on the control relay 9*a* and 10*a* (FIG. 3, (B)) to start the data transmitting device on the front or rear car, i.e., the data transmitting device 5*b* on the rear car 2 in this case. As a result, the signal receiving relay 11*b* is turned on by the power source 7 (FIG. 3, (C)), whereupon data can be transmitted between the data transmitting device 4*b* and the central station data transmitting device 4*a*. The data transmitting device 4*b*, as indicated by a signal X in waveform (D) of FIG. 3, registers the number of the car 2 and the position of the car 2 from the front car in the data transmitting device 4*a* through the transmitting lines 5, Of course, the car number has been inputted in the data transmitting device 4*b*, and the position of the car is counted with a signal from the data transmitting device 4*a*.

Figure 3:
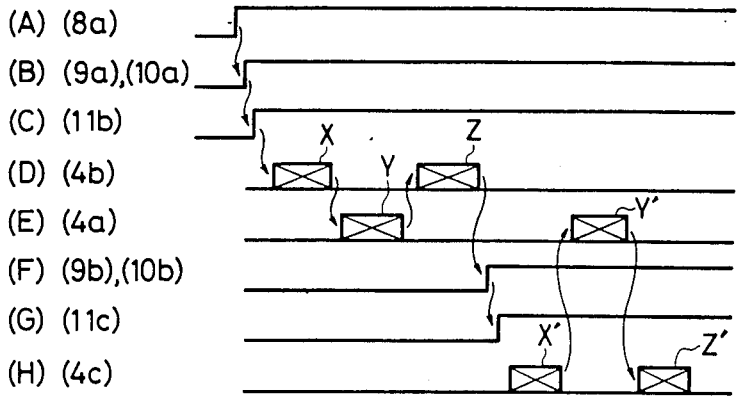
FIGS. 3(A) to 3(H) are diagrams for explaining the operation of the car order selecting device shown in FIG. 2.

Next, the data transmitting device 4*a* informs the data transmitting device 4*b* of the fact that the data transmitting device 4*b* has been connected to the data transmitting device 4*a* and the car number, etc., have been registered (the signal Y in waveform (E) of FIG. 3). The data transmitting device 4*b* transmits a confirmation signal Z to the central station data transmitting device 4*a* to end the communication. (The transmission of the confirmation signal Z may be omitted.)

In order to start the data transmitting device 4*c* on the following car 3, the data transmitting device 4*b* turns on the control relays 9*b* and 10*b* (FIG. 3, (F)), and the signal receiving relay 11*c* (FIG. 2, (G)). The signal from the signal receiving relay 11 allows data communication between the data transmitting device 4*c* and the central station data transmitting device 4*a*. *Under this condition, the data transmitting device 4c* transmits a transmission signal X' to register the number of the car 3, etc., in the central station data transmitting device 4*a* (FIG. 3, (H)). Upon reception of the signal X', the central station data transmitting device 4*a* registers the number of the car 3 and the fact that the position of the car 3 is the third from the front car 1, and transmits a completion signal Y' to the data transmitting device 4*c* (FIG. 3, (E)). The data transmitting device 4*c* transmits a confirmation signal Z' to the central station data transmitting device 4*a*. (The transmission of the confirmation signal Z' may be omitted.) The control relay 9*c* and 10*c* of the data transmitting device 4*c* is operated to determine whether or not there is a car after the car 3. In the case of a train of three cars, the detection of the following car is ended. In the case where it is determined that the car 3 is followed by another car, the number of the car is registered in the same manner. Thus, in the case of a train of more than two cars, merely by selecting the front car 1, the data transmitting devices 4*a*, 4*b* and 4*c* are started successively, and the position of each car is registered. Therefore, the conditions of all the cars can be comprehended through the display unit 40*a* of the central station data transmitting device 4*a*.

Figure 4:
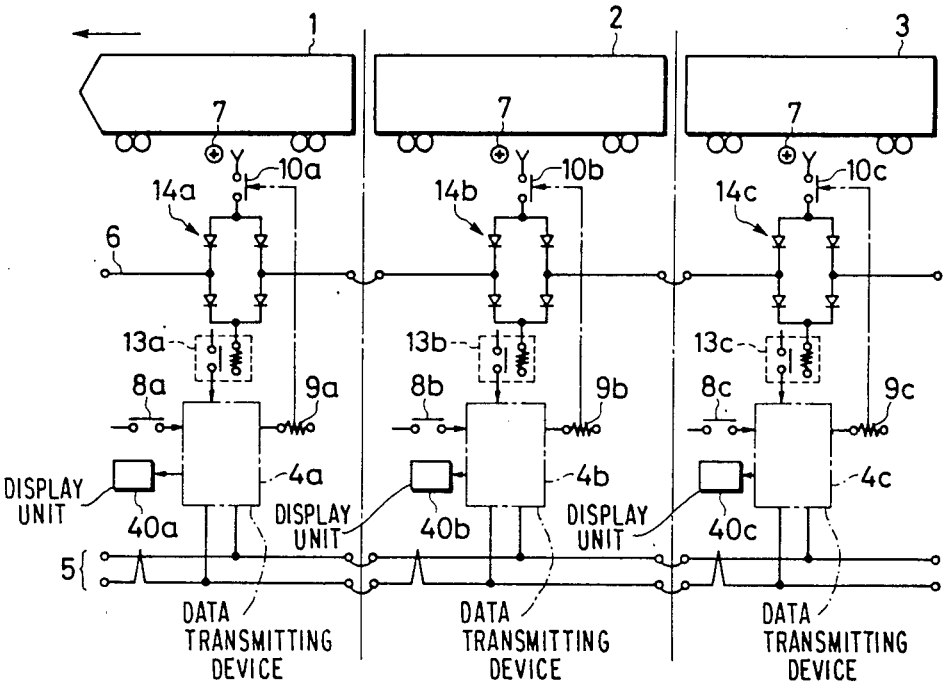
FIGS. 4 and 5 are connection diagrams showing other embodiments of the invention.

FIG. 4 shows another embodiment of the invention. In FIG. 4, elements corresponding functionally to those already described with reference to FIG. 2 are designated by the same reference numerals or characters. Further in FIG. 4, 13*a*, 13*b* and 13*c* designate signal receiving relays corresponding to the signal receiving relays 11*a*, 11*b* and 11*c*, and 12*a*, 12*b* and 12*c*. Diode circuits 14*a*, 14*b* and 14*c* are connected between the power sources 7 of the cars and the signal receiving relays 13*a*, 13*b* and 13*c*, respectively. Each diode circuit is a parallel circuit of two series circuits of diodes, the forward direction being from the power source 7 towards the signal receiving relay (13). The connecting points of these diodes are connected to the extension lines 6.

Figure 1:
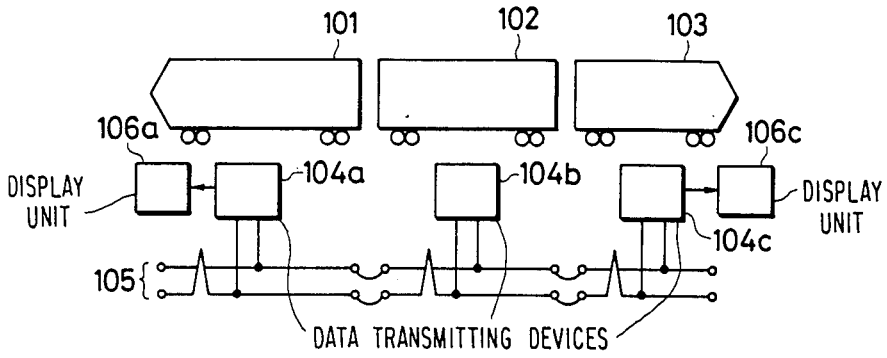
FIG. 1 PRIOR ART
FIG. 1 is a connection diagram showing a conventional carriage order selecting system.

The operation of the second embodiment shown in FIG. 4 is completely the same as that of the first embodiment shown in FIG. 2. For instance, in the case where the car 1 is the front car and the data transmitting device 4*a* serves as the central station, the control relay contact 10*a* is closed. Therefore, the power source 7 is connected through the control relay contact 10*a* and the diode circuits 14*a* and 14*b* to the signal receiving relay 13*b* to close the latter, as a result of which data can be transmitted between the data transmitting device 4*b* and the central station 4*a*. When, after communication, the control relay contact 10*b* of the data transmitting device 4*b* is closed, similarly, the power source 7 is connected through the diode circuits 14*b* and 14*c* to the signal receiving relay 13*c* to close the latter 13*c* so that data can be transmitted between the data transmitting device 4c and the central station 4a. In starting the data transmitting devices of the following cars successively, similar to the case of FIG. 1, the power sources 7 are connected to the data transmitting device of the instant car and the data transmitting device of the front carriage; however, no problem is caused because both the data transmitting devices have been started already. However, control may be effected by the central station so that the start signal is applied selectively to the data transmitting devices.

Figure 5:
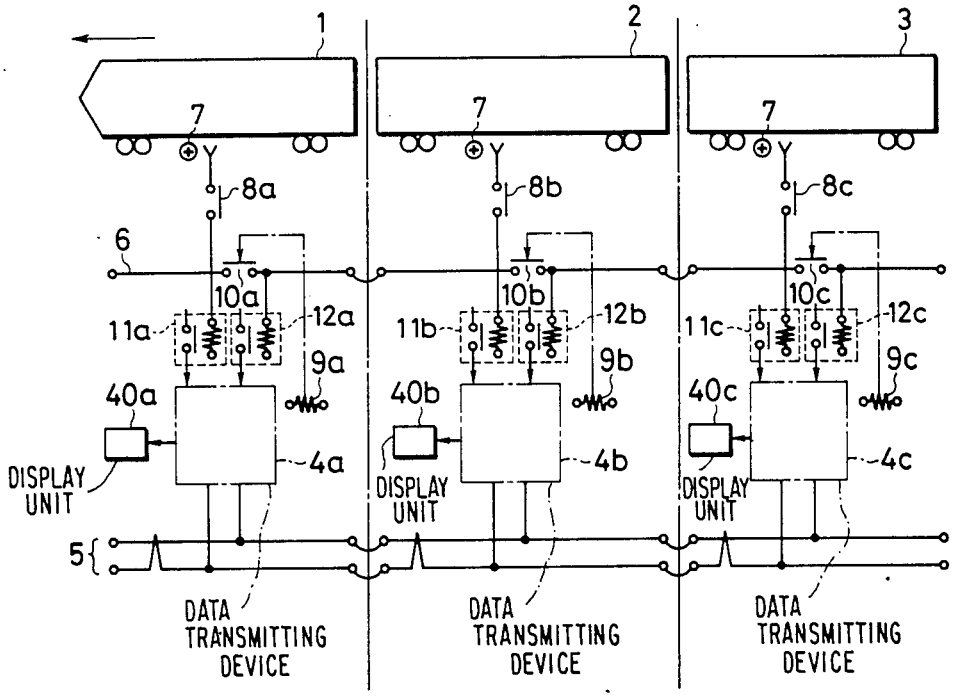

FIG. 5 shows a third embodiment of the invention in which selecting relays 8a, 8b and 8c (head control relays) are employed as power supplying relay contacts. When the front car 1 is selected, the selecting relay 8a is closed. As a result, the power source 7 is connected to the extension line 6, and the power is applied through the signal receiving relay 11a to the data transmitting device 4a so that the latter operates as the central station. When the control relay contact 10a is closed, the extension line for the adjacent, following car is connected. Therefore, the data transmitting device 4b is started through the signal receiving relay 11b. Continuing this way, the data transmitting devices are started successively. Therefore, power is supplied from the front car 1 through the extension lines 6 to all other cars.

In FIGS. 2, 4 and 5, the leftmost car is the front car of the train. In the case where the rightmost car is the front car, the data transmitting devices of the cars are successively started beginning from the rightmost one in the same manner, and the identifying numbers of the cars are registered in the central station data transmitting device 4c in this case. In any case, the front car is at the end of the train. Therefore, even if a plurality of cars output signals through the extension lines 6 at the same time, the data transmitting devices are successively started beginning from the one on the front car; that is, the data transmitting devices are started in the order of connection of the cars.

The aforementioned signal receiving relays 11a, 11b and 11c, and 12a, 12b and 12c, and the above-described signal receiving relays 13a, 13b and 13c, may be incorporated in the digital circuits (not shown) of the data transmitting devices.

As described above, according to the invention, the data transmitting devices on the following cars are started through extension lines which are connected into one line and include logic circuits. Therefore, the inventive car order selecting system can be readily constructed at a low cost. Accordingly, the data transmitting devices in a train of more than two cars can be successively started without interference, and the positional order of the cars can be correctly detected.

We claim:

1. In a train having more than two cars, data transmitting devices installed on each said car, and data transmitting lines for transmitting data between said data transmitting devices, a car order selecting system comprising:

selecting relays for applying an input signal to one of said data transmitting device to select a front car in said train;

extension lines connected into one line to connect said data transmitting devices to one another and are used to select a car order; and logic circuits provided for each of said extension lines to supply, in response to an output signal from said data transmitting device, a supply voltage to the following data transmitting device, wherein the detection of said front car results in starting said data transmitting devices on the following cars successively, and registering the positional order of the following cars in said data transmitting device on said front car.

2. The system as claimed in claim 1, in which each of said logic circuits comprises: a control relay having a control relay coil and control relay contact means closed by said control relay coil, said data transmitting devices to which a supply voltage is applied being successively selected by means of said control relays.

3. The system as claimed in claim 2, in which each of said logic circuits comprises two signal receiving relays connected to a power source to apply a supply voltage to the respective data transmitting device, adjacent data transmitting devices being connected through said extension lines connected to connecting points of said signal receiving relays and said control relay contact means.

4. The system as claimed in claim 3, in which each logic circuit comprises a diode circuit connected between the respective control relay contact means and the respective signal receiving relay and the forward direction of which is a supply voltage application direction, said extension lines being connected to said diode circuits.

5. The system as claimed in claim 2, in which each logic circuit comprises a selecting relay connected between the respective power source and the respective data transmitting device, said extension lines being connected to the connecting points of said selecting relays and data transmitting devices, and said control relay contact means being provided on said extension lines between said data transmitting devices.

* * * * *